US005763132A

United States Patent [19]

Ott et al.

[11] Patent Number: 5,763,132

[45] Date of Patent: Jun. 9, 1998

[54] TONER COMPOSITIONS

[75] Inventors: Mary L. Ott; Scott M. Silence, both of Fairport; Samir Kumar, Rochester, all of N.Y.

[73] Assignee: Xerox Corporation, Stamford, Conn.

[21] Appl. No.: 842,924

[22] Filed: Apr. 17, 1997

[51] Int. Cl.[6] ..... G03G 9/06

[52] U.S. Cl. ..... 430/137

[58] Field of Search ..... 430/106, 109, 430/111, 137

[56] References Cited

U.S. PATENT DOCUMENTS

| | | | |
|---|---|---|---|
| Re. 33,172 | 2/1990 | Gruber et al. | 430/39 |
| 3,590,000 | 6/1971 | Palermiti et al. | 252/62.1 |
| 3,893,935 | 7/1975 | Jadwin et al. | 252/62.1 |
| 3,900,588 | 8/1975 | Fisher | 427/19 |
| 4,078,929 | 3/1978 | Gundlach | 96/1.2 |
| 4,221,856 | 9/1980 | Lu | 430/110 |
| 4,265,990 | 5/1981 | Stolka et al. | 430/59 |
| 4,291,111 | 9/1981 | Lu | 430/107 |
| 4,291,112 | 9/1981 | Lu | 430/110 |
| 4,298,672 | 11/1981 | Lu | 430/108 |
| 4,338,390 | 7/1982 | Lu | 430/106 |
| 4,935,326 | 6/1990 | Creatura et al. | 430/108 |
| 4,937,166 | 6/1990 | Creatura et al. | 430/108 |
| 5,510,221 | 4/1996 | Matalevich et al. | 430/106.6 |
| 5,552,252 | 9/1996 | Lundy et al. | 430/39 |
| 5,565,195 | 10/1996 | Tavernier et al. | 430/111 |
| 5,620,823 | 4/1997 | Kambayashi et al. | 430/111 |
| 5,637,432 | 6/1997 | Okado et al. | 430/109 |

*Primary Examiner*—John Goodrow
*Attorney, Agent, or Firm*—E. O. Palazzo

[57] ABSTRACT

A process for decreasing toner adhesion and decreasing toner cohesion which comprises adding a spacer component of a polymer, a metal, a metal oxide, a metal carbide, or a metal nitride, to the surface of a toner comprised of resin, wax, compatibilizer, and colorant excluding black, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner.

32 Claims, 2 Drawing Sheets

TONER COMPOSITIONS

There is illustrated in application U.S. Ser. No. 08/843,883 now U.S. Pat. No. 5,716,752 filed concurrently herewith, the disclosure of which is totally incorporated herein by reference, toners with spacers, such as magnetites.

BACKGROUND OF THE INVENTION

The invention is generally directed to color toner and developer compositions, and more specifically, the present invention is directed to developer and toner compositions containing very large external additives (VLA), such as polymers like polymethylmethacrylate (PMMA), boron, aluminum or silicon nitride, silicon carbide, strontium, magnesium or barium titanate, barium or strontium zirconate and tin, yttrium, aluminum or beryllium oxide, and which additives function primarily to eliminate, or minimize development falloff characteristics, and wherein the additives are present on the toner surface and function primarily as spacers between the toner and carrier particles thereby reducing the impaction of small conventional toner surface additives of, for example, a size of from about 8 to about 20 nanometers, such as silicas and titanias, during aging in the development housing. Further, the aforementioned very large external additives are mostly colorless, thus when they are applied to the toner surface they do not significantly reduce the color gamut which is achievable with the combination of cyan, yellow, magenta, and black toners.

More specifically, the present invention relates to processes for decreasing toner adhesion and cohesion and reducing toner aging, that is the adhesivity and cohesivity increase of the toner with time in the development housing, and wherein less amounts and smaller size surface additives, for example from about 8 to about 20 nanometers, such as colloidal or fumed silicas and titanias, may be selected. Therefore, in embodiments, the use of large sized toner surface additives, for example about at least 40 nanometers, of fumed silica and titania can be avoided. The invention in embodiments relates to the continuous injection of very large additives, for example from about 100 nanometers to about 500 nanometers, and preferably from about 100 to 200 nanometers, such as PMMA (polymethylmethacrylate), in an amount of less than or equal to about 12 weight percent, and more specifically, from about 1 to about 12 weight percent, and preferably from about 3 to about 9 weight percent at grinding during the toner size-reduction process, and which enables an increase in the stability of color developers, and avoids, or minimizes, the disadvantages of burial of the functional small size, for example from about 8 nanometers to about 20 nanometers in diameter, surface additives by the development housing during the imaging process in powder cloud development systems. The very large additives, such as PMMA, primarily function as a spacer-type barrier, thus the smaller, from about 8 to about 20 nanometers in diameter functional additives of, for example, silica and titania, are shielded from contact forces great enough to embed them in the toner surface. Disclosed is a developer wherein the toner possesses a small, less than about 12 percent by weight, amount of tightly bound, low cost, very large additives, for example from about 100 to about 500 nanometers, $d_{50}$=200 nanometers, such as polymethylmethacrylate, together with small sized toner surface additives, and wherein the VLA provides a barrier and minimizes the burial of the small sized toner surface additives, thereby rendering a developer with improved flow stability and hence excellent development and transfer stability during copying/printing in xerographic imaging processes under the conditions of low toner area coverage of a page, for example when less than about 3 percent of the area of a document has toner applied to the surface. The toner compositions of the present invention in embodiments thereof maintain their DMA (developed mass per area on a photoreceptor), their TMA (transferred mass per area of a photoreceptor), and acceptable triboelectric charging characteristics for an extended number of imaging cycles. The toner and developer compositions of the present invention can be selected for electrophotographic, especially xerographic, imaging and printing processes, including digital processes.

Toner cohesion refers to toner particles adhering to each other, and toner adhesion refers to toner particles adhering to a donor roll. Both these disadvantages are avoided or minimized with the processes of the present invention.

PRIOR ART

Toner and developer compositions with charge enhancing additives, which impart a negative charge to the toner resin, are known. Thus, for example, there is described in U.S. Pat. No. 3,893,935 the use of quaternary ammonium salts as charge control agents for electrostatic toner compositions. Similar disclosures are presented in U.S. Pat. No. 4,291,112 wherein A is an anion including, for example, sulfate, sulfonate, nitrate, borate, chlorate, and the halogens. There are also described in U.S. Pat. No. 2,986,521 reversal developer compositions comprised of toner resin particles coated with finely divided colloidal silica. According to the disclosure of this patent, the development of electrostatic latent images on charged surfaces is accomplished by applying a developer composition having a positively charged triboelectric relationship with respect to the colloidal silica.

Also, there are disclosed in U.S. Pat. No. 4,338,390, the disclosure of which is totally incorporated herein by reference, developer compositions containing as charge enhancing additives organic sulfate and sulfonates, which additives can impart a positive charge to the toner composition. Further, there are disclosed in U.S. Pat. No. 4,298,672, the disclosure of which is totally incorporated herein by reference, positively charged toner compositions with resin particles and pigment particles, and as charge enhancing additives alkyl pyridinium compounds. Additionally, positively charged toner compositions with charge control additives are illustrated, for example, in U.S. Pat. Nos. 3,944,493; 4,007,293; 4,079,014; 4,394,430, and 4,560,635, which illustrates a toner with a distearyl dimethyl ammonium methyl sulfate charge additive.

Although many toners are known, there continues to be a need for toners and processes which possess many of the advantages illustrated herein. Moreover, there continues to be a need for colored toner compositions that are useful for incorporation into various color imaging processes, as illustrated in U.S. Pat. No. 4,078,929, the disclosure of which is totally incorporated herein by reference, laser printers, and the like; and additionally a need for toner compositions useful in imaging apparatuses having incorporated therein layered photoresponsive imaging members such as the members illustrated in U.S. Pat. No. 4,265,990, the disclosure of which is totally incorporated herein by reference. Also, there is a need for toner compositions which have the desired triboelectric charge level, for example from about 10 to about 40 microcoulombs per gram, and preferably from about 10 to about 25 microcoulombs per gram, and admix charging rates of from about 5 to about 60 seconds, and preferably from about 15 to about 30 seconds, as determined by the known charge spectrograph, and which toners possess improved toner aging, and excellent flow stability (desirable adhesion and cohesion characteristics with aging in aggressive developer housings).

SUMMARY OF THE INVENTION

It is an object of the present invention to provide toner and developer compositions with many of the advantages illustrated herein.

In another object of the present invention there are provided negatively charged toner compositions useful for the development of electrostatic color latent images.

In yet another object of the present invention there are provided processes for decreasing toner adhesion and cohesion, and minimizing or eliminating toner aging.

Also, in another object of the present invention there are provided processes and compositions wherein the size of the toner surface additives, such as silicas and titanias, can be reduced, for example, from about 40 nanometers or greater to about less than, or equal to about 20 nanometers, and the amount of surface additives selected can be reduced, for example from greater than, or equal to about 5 percent by weight to less than about 2.5 percent by weight thereby reducing the cost of the toner.

Additionally, in another object of the present invention there are provided toners which accomplish these advantages without a significant decrease in the color gamut in an electrophotographic imaging apparatus.

Moreover, in another object of the present invention there are provided processes and compositions wherein the size of the toner surface additives, such as silicas, metal oxides, and titanias, can be reduced from additive diameters of about 40 nanometers or greater, such as from about 40 to about 100, to additive diameters of about 20 nanometers or less, for example from about 7 to about 15, and the amount of surface additives selected can be reduced from greater than about 6, for example from about 6 to about 12 percent by weight of the toner to less than about 2 percent, and specifically from about 0.05 to about 1.5 weight percent, by weight of the toner.

In yet a further object of the present invention there are provided colored toners with acceptable triboelectric charging characteristics of from about −10 to about −40 microcoulombs per gram against, for example, a carrier comprised of a core, preferably an irregularly shaped steel core with a diameter of between about 50 and about 125 micrometers, and a coating polymer, such as poly(methylmethacrylate), polystyrene, or poly(urethane), which coating may optionally contain a conductive additive, such as conductive carbon black or tin oxide, in sufficient quantity to render the carrier conductive, and which toners exhibit minimal variations in xerographic development subsystem environments.

Another object of the present invention resides in the formation of toners which will enable the development of images in electrophotographic imaging apparatuses, which images have substantially no background deposits thereon, are substantially smudge proof or smudge resistant, and therefore, are of excellent resolution; and further, such toner compositions can be selected for high speed electrophotographic apparatuses, that is those exceeding 100 copies per minute.

BRIEF DESCRIPTION OF THE FIGURES

Illustrated in the FIGS. 1–2 are graphs showing, for example, some advantages achievable with the toner and processes of the present invention.

EMBODIMENTS

Figure 1:
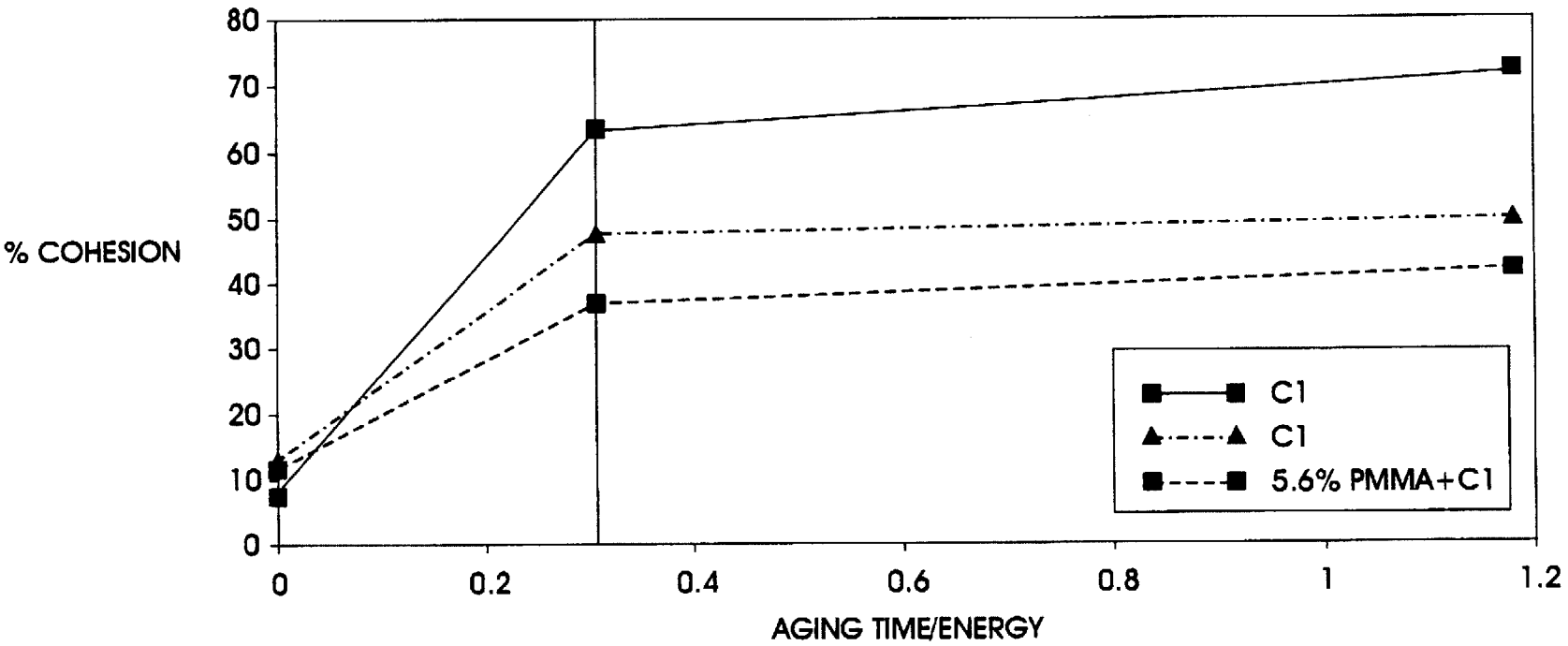

These and other objects of the present invention can be accomplished in embodiments thereof by providing toners and developers thereof with the advantages illustrated herein. More specifically, the present invention in embodiments is directed to processes wherein there is added to the toner surface large spacer components of PMMA, nitrides, titanates, zirconates or oxides, which components possess a density of, for example, 1.1 grams/cc, or greater, and more specifically, for example, from about 1 to about 5 grams/cc. These components are added to the toner surface in various effective amounts, such as from about less than about 1 weight percent to about 12 weight percent, and preferably from about 3 weight percent to about 9 weight percent.

Embodiments of the present invention include a process for decreasing toner adhesion and decreasing toner cohesion which comprises adding a spacer component of a polymer, a metal, a metal oxide, a metal carbide, or a metal nitride, to the surface of a toner comprised of resin, wax, compatibilizer, and colorant excluding black, and wherein toner surface additives are blended with the toner, and wherein the component is permanently attached to the toner surface by the injection of the component in a fluid bed milling device during the size reduction process of the toner contained in the device, and where the power imparted to the toner to obtain the attachment is from equal to, or about above 5 watts per gram of toner; a process wherein the component is aluminum oxide, or polymethylmethacrylate, and which component is added in an amount of from about 1 to about 12 weight percent, the injection is continuous, and the colorant is a pigment; a process wherein the power is from about 6 to about 15 watts per gram of toner, the component is polymethylmethacrylate, the colorant is a pigment, and the injection is continuous; a process wherein the component is boron nitride, silicon carbide, silicon nitride, strontium titanate, tin oxide, barium titanate, magnesium titanate, barium zirconate, strontium zirconate, yttrium oxide, aluminum oxide, or aluminum nitride, and the toner surface additives are comprised of silica and titania; a process for decreasing toner adhesion and decreasing toner cohesion which comprises adding a polymer to the surface of a toner comprised of resin, compatibilizer, wax, and colorant excluding black, and wherein the polymer is permanently attached to the toner surface by continuous injection of the polymer in a fluid bed milling device during the size reduction process of the toner, and where the specific power imparted to the toner during the attachment process is equal to, or above about 5 watts per gram of toner; a process wherein the power is from about 10 to about 15 watts per gram of toner, the colorant is a pigment, the polymer is polymethylmethacrylate, and the injection is continuous; a process wherein the polymer component is selected in an amount of from about 3 to about 9 weight percent, and the colorant is a pigment; a process wherein the polymer component is polymethylmethacrylate selected in an amount of form about 6 to about 9 weight percent, and the colorant is a pigment; a process wherein the toner further includes surface additives; a process wherein the surface additives are silica, titania, zinc stearate, or mixtures thereof, and wherein each of the additives are selected in an amount of from about 0.1 to about 1 weight percent; a process wherein the toner is substantially free of aging for about 500,000 imaging cycles in a xerographic imaging or printing apparatus; a process wherein the toner is substantially free of aging for about 500,000 imaging cycles in a xerographic imaging or printing apparatus; a process wherein the toner contains surface additives of silica and titanium oxide in an amount of from about 0.1 to about 0.75 weight percent, and which surface additives possess a diameter from about 8 to about 20 nanometers; a process wherein the resin is a polyester; a process wherein the colorant is the pigment red, blue, yellow, green, brown, orange, cyan, magenta, or mixtures thereof; a process wherein the pigment is present in an amount of from about 2 to about 12 weight percent; a process which comprises adding a spacer component with a diameter of from about 100 nanometers to about 500 nanometers to a toner comprised of resin, colorant, wax, compatibilizer, and surface additives, and wherein the component is permanently attached to the toner surface by the continuous injection of the component in a fluid bed milling device during the size reduction process of the toner contained in the device, and where the power imparted to the toner during the attachment is at least about 5 watts per gram of toner; a process wherein the surface additives are comprised of fumed silica and metal oxides each present in an amount of from about 0.1 to about 0.5 weight percent, and each with a diameter of from about 8 nanometers to about 20 nanometers, the colorant is a pigment excluding black, and the power is from about 10 to about 15 watts; a process wherein the resin is a styrene acrylate, a styrene methacrylate, a styrene butadiene, or a polyester; the wax is of a low molecular weight $M_w$ of from about 1,000 to about 20,000; and the wax is present in an amount of from about 3 to about 10 weight percent; a process wherein the toner further contains a charge enhancing additive; a process wherein the resin is present in an amount of from about 75 to about 95 weight percent, the colorant is a pigment excluding black and is present in an amount of from about 2 to about 12 weight percent, the wax is present in an amount of from about 2 to about 5 weight percent, and the compatibilizer is present in an amount of from about 1 to about 5 weight percent; and wherein the total percent is about 100; a process wherein the toner is mixed with carrier particles; a process wherein the carrier contains a coating thereover of a polyvinylidine fluoride, a polymethyl methacrylate, or a mixture of polymers not in close proximity in the triboelectric series; a process which comprises adding a spacer component of polymer to the surface of a toner comprised of resin, wax, compatibilizer, and colorant excluding black, and wherein toner surface additives are optionally blended with the toner, and wherein the spacer component is permanently attached to the toner surface; and a process wherein the polymer is polymethylmethacrylate, and the colorant is a pigment.

The toner compositions of the present invention can be prepared by a number of methods such as melt mixing and heating resin particles, such as a crosslinked polyester, with from about 3 to about 7 percent gel, most preferable about 5 weight by the letdown of about 37 to about 40 percent crosslinked polyester resin, color pigment particles, such as Pigment Red 81:3, Neopen Yellow, REGAL 330®, SUN Blue 15103, in a toner extrusion device, such as the ZSK40 available from Werner Pfleiderer, and removing the formed toner composition from the device. Letdown of the about 37 to about 40 percent crosslinked polyester resin refers to the lowering of the gel concentration, for example to about 5 percent, and more specifically, refers to a process where a 37 to 40 percent crosslinked polyester resin is melt mixed and heated in an extrusion device, such as the ZSK40 available from Werner Pfleiderer, with a suitable amount of uncrosslinked polyester resin in an environment where no additional crosslinking occurs such that the gel content of the final product is lower than about 37 to about 40 percent, for example about 5 percent.

Subsequent to cooling, the toner composition can be subjected to grinding utilizing, for example, an Alpine Fluid Bed Grinder (AFG) for the purpose of achieving toner particles with a volume median diameter of less than about 25 microns, and preferably from about 8 to about 12 microns, which diameters are determined by a Coulter Counter. The very large additives are continuously injected at an appropriate rate during the toner size reduction process, and to enable a desired weight percent of very large additives, for example from about 3 to about 9 percent by weight in the ground product, and which additives are permanently attached to the toner surface. For example, for a 200AFG grinder with a toner grind rate of 14 pounds per hour, the very large additive injection rate is from about 0.6 pound per hour to about 1.8 pounds per hour. The very large additives, such as PMMA, can be injected alone or with a flow aid, such as Cabosil Fumed Silica TS-530 or Tayca MT3103 titania, as a mixture to ease the feeding and handling of magnetites. The very large additive can be premixed with fumed silica or titania at various effective ratios, such as about 30:1. The very large additive and silica, or titania mixture is continuously injected to the AFG grind chamber by a pneumatic solids conveying system. More specifically, the very large additive, like silica or very large additive/titania mixture, is continuously fed to the funnel at a desired rate of, for example, from about 0.6 pound per hour to about 1.8 pounds per hour for a toner grind rate of 14 pounds per hour using a Merrick Groove Disk feeder (22-01). The FOX venturi eductor provides a suction high enough at the feed funnel to entrain the very large additive/silica or very large additive/titania mixture in the air stream. The entrained mixture is accelerated and conveyed through the discharge pipe to the grind chamber. The entry to the grind chamber through the feed port is tangential, which provides sufficient opportunity for the dispersed additive (very large additive and silica or titania) to contact the large toner particles flowing down along the wall. The very large additive together with silica, titania, or mixtures thereof are disintegrated to primary aggregate size range due to the jetting effect in the grinding zone. This allows for a rapid access of primary size additive aggregates to the virgin surface of individual toner particles, which toners are continuously formed due to jetting. As evidenced, for example, by scanning electron microscopy, the very large additive becomes firmly and permanently attached to the toner surface primarily because of the inherent mixing pattern in the fluid bed grinders.

The surface additives can be blended on the toner surface and over the VLA. The process of continuous injection of the VLA, such as PMMA, at grinding is of high importance to the process of the present invention. Continuous injection of the VLA at grinding enables formation of a tightly bound, uniform coverage of the VLA on the toner surface primarily due to intense distributive and dispersive mixing in the fluid bed grinding zone. For example, typical batch additive blending processes using a Henschel-type batch blender impart a specific power of less than about 0.7 watt per gram of toner to the toner, and with the process of the present invention, especially in the continuous aspect of the process, there is selected a specific power of at least about 5 watts, and more specifically, from about 10 to about 15 watts per gram of toner to the toner.

Subsequently, the toner compositions can be classified utilizing, for example, a Donaldson Model B classifier for the purpose of removing fines, that is toner particles less than about 4 microns volume median diameter. There is also removed free/loosely attached very large additive as fines.

Subsequent to classification, the toner is blended with conventional small-sized (low cost) known external additives, such as silica and titania, in Henschel FM-10 blender.

External additives on the toner surfaces primarily influence toner xerographic performance, such as toner tribo, and the toner's ability to flow properly. The additive presence on the toner surface may increase toner tribo or suppress toner tribo depending, for example, on the toner resin and toner additive selected. A toner with a very low triboelectric value, for example less than about 8 microcoulombs per gram, is very difficult to control xerographically, while a toner with very high tribo, for example greater than about 40 microcoulombs per gram, is difficult to release from the carrier. Therefore, stable tribo in a xerographically appropriate range is desirable. Further, in powder cloud development systems, such as Hybrid Jumping Development, an acceptable level of toner flow (cohesion and adhesion) is desired throughout the imaging process; for example, a toner cohesion in the range of from about 10 percent to about 65 percent, measured using a standard process on a Hosokawa powder tester (Hosokawa Powder Micron Systems, Inc.), is desired throughout the imaging process. Xerographic development in these systems is believed to involve individual toner particles jumping back and forth between roll surfaces and photoreceptor surfaces multiple times, some initiating cascade effects for others. Thus, the adhesion of toner to the roll/photoreceptor, and the cohesion of toner particles to each other as a function of toner residence time in development housing is to be maintained at an acceptable, or suitable level. As one consequence, additive present on the toner surface should be stable to minimize changes in the state of the toner with variation in solid area coverage. In a developer housing, carrier beads collide with toners and the force from the collision tends to drive the external additives into the toner surface. As the additives are impacted into the toner surface with time, toner tribo and toner flowability will usually change. In an aggressive development housing, toner flowability degrades rapidly, for example with a toner cohesion increasing from a value of less than 15 percent to a value of greater than 75 percent under conditions of low toner area coverage of a document, during either xerographic copying or printing, in a period of less than 1,500 prints that are generated in a xerographic imaging system. The increase in cohesion of toner particles and adhesion to the donor roll, beyond an acceptable threshold level of about 65 percent toner cohesion, leads to loss of development. With the present invention in embodiments thereof there is provided a toner surface that withstands the impact of the carrier bead collisions and prevents or limits toner surface additive impaction.

Evidence that the use of PMMA as a hard spacer provides advantages through adhesion measurements is further illustrated with reference to FIG. 1.

In the FIG. 1 graph experiments, flow stability with respect to mechanical aging at the bench is shown with a Hybridizer Mechanical Aging Protocol. In this test, the blended (unaged) toner is subjected to an energetic environment by a surface processing device (NHSO Hybridizer, Nara Corporation) and the cohesion of toner is measured thereafter. FIG. 1 shows the percent cohesion rise, or increase with respect to aging time/energy for toners comprised of 75.67 parts by weight of a linear polyester (RESAPOL HT), 17.73 parts by weight of the crosslinked polyester (34 percent gel content), 6.60 parts by weight of LUE 1510345 melt blended at approximately 80°to 120° C. in a ZSK40 extruder, followed by micronization and air classification to yield toner particles of a size of 7.5 microns in volume average diameter and 5 microns in number average diameter. Further, the toner labeled C1 has small external additives blended onto the surface consisting of 0.9 weight percent of TD3103, which is a 16 nanometer diameter titania, 0.6 weight percent of TS530, which is an 8 nanometer diameter fumed silica, and 0.3 weight percent of zinc stearate, which is a film forming additive. The toner labeled C2 has large external additives blended onto the surface with 2.5 weight percent of SMT5103, which is a 40 nanometer diameter titania, 4.2 weight percent of RX50, which is a 40 nanometer diameter fumed silica, and 0.3 weight percent of zinc stearate. The toner labeled 5.6 percent PMMA+C1 has 5.6 weight percent of the very large additive PMMA (polymethylmethacrylate) injected at grind prior to the blending of a small external additive mixture of 0.9 weight percent of TD3103, which is a 16 nanometer diameter titania, 0.6 weight percent of TS530, which is an 8 nanometer diameter fumed silica, and 0.3 weight percent of zinc stearate.

The very large additive PMMA injected at grind of 5.6 weight percent toner with the above small external additive mixture package indicates improved flow stability with respect to the same toner without the very large additive PMMA injected at grinding, nearly equivalent to the flow stability of the toner blended with the large external additive.

Figure 2:
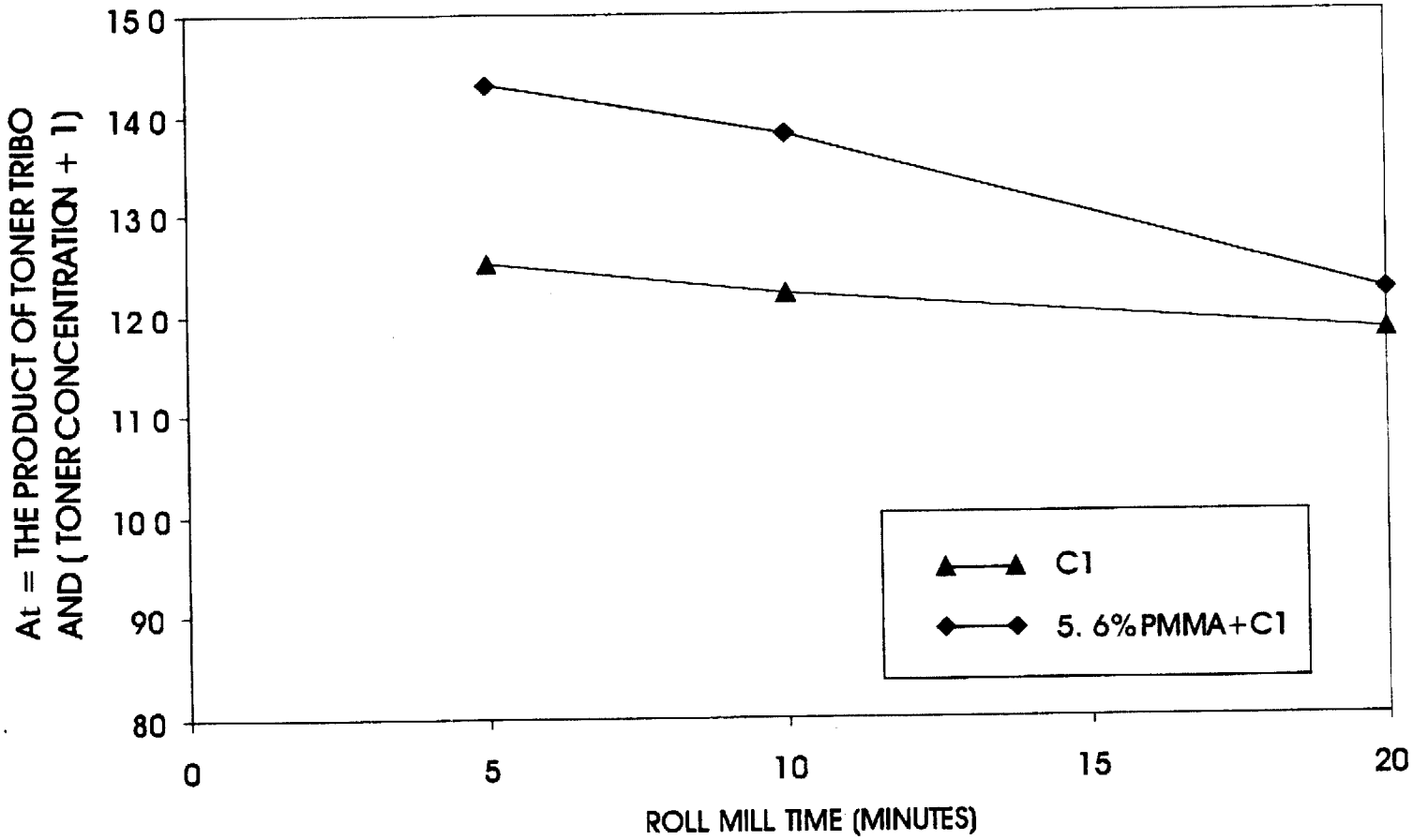

The addition of the very large external additive PMMA injected at the grinding step of the toner manufacturing process also enhances the triboelectric stability of the toner, as is illustrated in FIG. 2. The toners shown in FIG. 2 are the same as the toners of FIG. 1, with the exception of the toner labeled C2 in FIG. 1, which C2 has been omitted in FIG. 2. The triboelectric values are measured against a carrier of a 65 micron irregular steel core coated with a polymethylmethacrylate polymer containing about 20 weight percent carbon black. The toner without the very large additive PMMA injected at grinding shows greater instability than the toner with PMMA injected at grinding, as the toner and carrier are mixed in a standard bench mixing device.

Illustrative examples of suitable toner resins, especially thermoplastic resins, selected for the toner and developer compositions of the present invention include polyamides, polyolefins, styrene acrylates, styrene methacrylates, styrene butadienes, polyesters, especially reactive extruded polyesters, crosslinked styrene polymers, epoxies, polyurethanes, vinyl resins, including homopolymers or copolymers of two or more vinyl monomers; and polymeric esterification products of a dicarboxylic acid and a diol comprising a diphenol. Vinyl monomers include styrene, p-chlorostyrene, unsaturated mono-olefins such as ethylene, propylene, butylene, isobutylene and the like; saturated mono-olefins such as vinyl acetate, vinyl propionate, and vinyl butyrate; vinyl esters like esters of monocarboxylic acids including methyl acrylate, ethyl acrylate, n-butylacrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; mixtures thereof; and the like; styrene butadiene copolymers with a styrene content of from about 70 to about 95 weight percent, reference the U.S. patents mentioned herein, the disclosures of which have been totally incorporated herein by reference. In addition, crosslinked resins, including polymers, copolymers, homopolymers of the aforementioned styrene polymers may be selected.

As one toner resin, there can be selected the esterification products of a dicarboxylic acid and a diol comprising a diphenol. These resins are illustrated in U.S. Pat. No.

3,590,000, the disclosure of which is totally incorporated herein by reference. Other specific toner resins include styrene/methacrylate copolymers, and styrene/butadiene copolymers; Pliolites; suspension polymerized styrene butadienes, reference U.S. Pat. No. 4,558,108, the disclosure of which is totally incorporated herein by reference; polyester resins obtained from the reaction of bisphenol A and propylene oxide; followed by the reaction of the resulting product with fumaric acid, and branched polyester resins resulting from the reaction of dimethylterephthalate, 1,3-butanediol, 1,2-propanediol, and pentaerythritol, reactive extruded polyesters, especially those with a gel amount of about 7 percent matte black toners, contain, for example, a gel content of about 30 percent, and the invention color toners posses, for example, a gel content of about 7 percent, reference U.S. Pat. No. 5,376,494, the disclosure of which is totally incorporated herein by reference, styrene acrylates, and mixtures thereof. Also, waxes with a molecular weight of from about 1,000 to about 10,000, such as polyethylene, polypropylene, and paraffin waxes, can be included in, or on the toner compositions as fuser roll release agents.

The resin particles are present in a sufficient, but effective amount, for example from about 70 to about 90 weight percent. Thus, when 1 percent by weight of the charge enhancing additive is present, and 10 percent by weight of pigment or colorant, such as magenta pigment, yellow pigment, cyan pigment, and the like, is contained therein, about 89 percent by weight of resin is selected.

Numerous well known suitable colorants, such as pigments, dyes, or mixtures thereof, and the like can be selected as the colorant for the toner particles including, for example, nigrosine dye, aniline blue, or mixtures thereof. The pigment should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of colorant, especially pigment may be selected.

There can be blended with the toner compositions of the present invention external additive particles including flow aid additives, which additives are usually present on the surface thereof. Examples of these additives include colloidal silicas, such as AEROSIL, metal salts and metal salts of fatty acids, inclusive of zinc stearate, metal oxides such as aluminum oxides, cerium oxides, titanium oxides, and mixtures thereof, which additives are generally present in an amount of from about 0.1 percent by weight to about 5 percent by weight, and preferably in an amount of from about 0.1 percent by weight to about 1 percent by weight. Several of the aforementioned additives are illustrated in U.S. Pat. Nos. 3,590,000 and 3,800,588, the disclosures of which are totally incorporated herein by reference..

Also, there can be included in the toner compositions of the present invention low molecular weight waxes, such as polypropylenes and polyethylenes commercially available from Allied Chemical and Petrolite Corporation, EPOLENE N-15 commercially available from Eastman Chemical Products, Inc., VISCOL 550-P, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions of the present invention are believed to have a molecular weight of from about 4,000 to about 7,000. Many of the polyethylene and polypropylene compositions useful in the present invention are illustrated in British Patent No. 1,442,835, the disclosure of which is totally incorporated herein by reference.

The low molecular weight wax materials are present in the toner composition of the present invention in various amounts, however, generally these waxes are present in the toner composition in an amount of from about 1 percent by weight to about 15 percent by weight, and preferably in an amount of from about 2 percent by weight to about 10 percent by weight.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with the charge enhancing additives of the present invention, illustrative examples of magenta materials that may be selected as pigments include, for example, 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, and the like. Illustrative examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of developer compositions, there are mixed with the toner particles carrier components, particularly those that are capable of triboelectrically assuming an opposite polarity to that of the toner composition. Accordingly, the carrier particles of the present invention are selected to be of a positive polarity enabling the toner particles, which are negatively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. Nos. 3,526,533 and 3,467,634, the disclosures of which are totally incorporated herein by reference; polymethyl methacrylates; other known coatings; and the like. The carrier particles may also include in the coating, which coating can be present in one embodiment in an amount of from about 0.1 to about 3 weight percent, conductive substances such as carbon black in an amount of from about 5 to about 30 percent by weight. Polymer coatings not in close proximity in the triboelectric series can also be selected, reference U.S. Pat. Nos. 4,937,166 and 4,935,326, the disclosures of which are totally incorporated herein by reference, including, for example, KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 500, and preferably from about 75 to about 125 microns thereby permitting them to possess sufficient density and inertia to avoid adherence to the electrostatic images during the development process. The carrier component can be mixed with the toner composition in various suitable combinations, such as from about 1 to 5 parts per toner to about 100 parts to about 200 parts by weight of carrier.

The toner and developer compositions of the present invention may be selected for use in electrostatographic imaging apparatuses containing therein conventional photoreceptors providing that they are capable of being charged positively. Thus, the toner and developer compositions of the present invention can be used with layered photoreceptors that are capable of being charged positively, reference a positive charging P/R such as those described in U.S. Pat. No. 4,265,990, the disclosure of which is totally incorporated herein by reference.

With further respect to the present invention, one developer composition is comprised of a toner comprised of 75.67 parts by weight of a linear polyester resin, bisphenol A propylene oxide fumarate (RESAPOL HT), 17.73 parts by weight of the crosslinked polyester resin, bisphenol-A propylene oxide fumarate with a 34 percent gel content, and 6.60 parts by weight of SUN BLUE 1510345, which toner has tightly bound uniform coverage on its surface of 5.7 weight percent of a very large additive PMMA particles with a volume median diameter of 430 nanometers obtained from Soken Chemical. Onto this toner can be blended external additives of 0.6 percent by weight of a surface-treated silica with an 8 nanometer particle size (TS-530 from Cabosil Corporation, with a surface treatment of hexamethyldisilazane and g-aminopropyl triethoxysilane), 0.9 percent by weight of a surface-treated titania with a 16 nanometer particle size (TD-3103 from Tayca Corporation, with a surface treatment of decylsilane), and 0.3 percent by weight of the film forming additive zinc stearate (obtained from Synpro Inc.). Subsequently, the above formulated toner, 4 parts by weight, was mixed with 96 parts by weight of the carrier comprised of 99 percent by weight of a 65 micron irregularly shaped steel core coated with 1 percent by weight of a Conductex SC Ultra conductive carbon black/poly (methylmethacrylate) composite to form a developer.

The following Examples are being provided to further illustrate various species of the present invention, it being noted that these Examples are intended to illustrate and not limit the scope of the present invention. Parts and percentages are by weight unless otherwise indicated.

EXAMPLE I

A cyan developer composition was prepared as follows: 75.67 parts by weight of a linear polyester resin, bisphenol A propylene oxide fumarate (RESAPOL HT), 17.73 parts by weight of the crosslinked polyester resin, bisphenol A propylene oxide fumarate with a 34 percent gel content, and 6.60 parts by weight of SUN BLUE 1510345 were melt blended at approximately 80°to 120° C. (Centigrade) in a ZSK40 extruder, followed by micronization and air classification to yield toner particles of a size of 7.5 microns in volume average diameter and 5 microns in number average diameter. The 200AFG grinder was operated with a 3 to 4 millimeter nozzle at 100 psig pressure. The grinder wheel speed was set to obtain the desired particle size. A mixture of very large additive PMMA (Soken Chemicals) with a volume median diameter of 430 nanometers, preblended with TS-530 silica at 19 parts PMMA and 1 part silica was continuously injected to the grind chamber at 6 weight percent of the grind rate during the size reduction process to yield a tightly bound uniform coverage of 5.7 weight percent of PMMA particles on the toner surface. Thereafter, the aforementioned toner particles were classified in a Donaldson Model B classifier for the primary purpose of removing fine particles, that is those with a volume median diameter of less than 3 to 4 microns. This toner (3 pound load) was subsequently blended with external additives of 0.6 percent by weight of a surface-treated silica with an 8 nanometer particle size (TS-530 from Cabosil Corporation, with a surface treatment of hexamethyldisilazane and g-aminopropyl triethoxysilane), 0.9 percent by weight of a surface-treated titania with a 16 nanometer particle size (TD-3103 from Tayca Corporation, with a surface treatment of decylsilane), and 0.3 percent by weight of the film forming additive zinc stearate (obtained from Synpro Inc.) at 2,360 RPM for 4 minutes on a Henschel FM-10 blender.

Subsequently, the above formulated toner, 4 parts by weight, was mixed with 96 parts by weight of carrier comprised of 99 percent by weight of a 65 micron irregularly shaped steel core coated with 1 percent by weight of a Conductex SC Ultra conductive carbon black/poly (methylmethacrylate) composite, and wherein mixing was accomplished in a paint shaker for 10 minutes.

The above prepared toner had a triboelectric charge of 24 microcoulombs per gram, and an admix time of 30 seconds.

The above prepared developer was aged using a bench roll mill technique to simulate xerographic developer housing aging. After 360 minutes of aging, which is equivalent to 60 minutes of aging in, for example, a Xerox Corporation 5090 xerographic developer housing without any toner throughput, the toner cohesion reached a value of 45 percent, significantly below the cohesion value of 75 percent reached under the same conditions for a toner with the identical formulation but without the PMMA spacer.

EXAMPLE II

A cyan developer composition was prepared as follows: 75.67 parts by weight of a linear polyester (RESAPOL HT), 17.73 parts by weight of crosslinked polyester (34 percent gel content), and 6.60 parts by weight of SUN BLUE 1510345 melt blended at approximately 80°to 120° C. in ZSK40 extruder, followed by micronization and air classification to yield toner particles of a size of 7.5 microns in volume average diameter and 5 microns in number average diameter. The 200AFG grinder was operated with a 3 to 4 millimeter nozzle at 100 psig pressure. The grinder wheel speed was set to obtain the desired particle size. A mixture of very large additives of $Al_2O_3$, obtained from Baikowski International, with an average particle diameter of 150 nanometers, preblended with TS-530 silica at 20 parts $Al_2O_3$ and 1 part silica was continuously injected to the grind chamber at 6 weight percent of the grind rate during the size reduction process to yield a tightly bound uniform coverage of 6 weight percent $Al_2O_3$ particles on the toner surface. Thereafter, the aforementioned toner particles were classified in a Donaldson Model B classifier for the purpose of removing fine particles, that is those with a volume median diameter of less than 3 to 4 microns. This toner (3 pound load) was subsequently blended with external additives of 0.6 percent by weight of a surface-treated silica with an 8 nanometer particle size (TS-530 from Cabosil Corporation, with a surface treatment of hexamethyldisilazane and g-aminopropyl triethoxysilane), 0.9 percent by weight of a surface-treated titania with a 16 nanometer particle size (TD-3103 from Tayca Corporation, with a surface treatment of decylsilane), and 0.3 percent by weight of the film forming additive zinc stearate (obtained from Synpro Inc.) at 2360 RPM for 4 minutes on a Henschel FM-10 blender.

Subsequently, the above formulated toner, 4 parts by weight, was mixed with 96 parts by weight of a carrier comprised of 99 percent by weight of a 65 micron irregularly shaped steel core coated with 1 percent by weight of a Conductex SC Ultra conductive carbon black/poly (methylmethacrylate) composite, and wherein mixing was accomplished in a paint shaker for 10 minutes.

The above prepared developer was aged using a bench roll mill technique to simulate xerographic developer housing aging. After 360 minutes of aging, which is equivalent to 60 minutes of aging in, for example, a Xerox Corporation 5090 xerographic developer housing without any toner throughput, the toner cohesion reached a value of 45 percent, significantly below the cohesion value of 75 percent reached under the same conditions for a toner with the identical formulation but without the $Al_2O_3$ spacer.

EXAMPLE III

A magenta developer composition was prepared as follows: 68.25 parts by weight of a linear polyester (RESAPOL HT), 20.0 parts by weight of crosslinked polyester (34 percent gel content), and 11.75 parts by weight of Luperton Pink were melt blended at approximately 80°to 120° C. in ZSK40 extruder, followed by micronization and air classification to yield toner particles of a size of 7.5 microns in volume average diameter and 5 microns in number average diameter. The 200AFG grinder was operated with 3 to 4 millimeter nozzles at 100 psig pressure. The grinder wheel speed was set to obtain desired particle size. A mixture of very large additive PMMA (Soken Chemicals) with a volume median diameter of 430 nanometers, preblended with TS-530 silica at 19 parts PMMA and 1 part silica was continuously injected to the grind chamber at 6 weight percent of grind rate during the size reduction process to yield a tightly bound uniform coverage of 5.7 weight percent of PMMA particles on the toner surface. Thereafter, the aforementioned toner particles were classified in a Donaldson Model B classifier for the purpose of removing fine particles, that is those with a volume median diameter of less than 3 to 4 microns. This toner (3 pound load) was subsequently blended with external additives of 0.6 percent by weight of a surface-treated silica with an 8 nanometer particle size (TS-530 from Cabosil Corporation, with a surface treatment of hexamethyldisilazane and g-aminopropyl triethoxysilane), 0.9 percent by weight of a surface-treated titania with a 16 nanometer particle size (TD-3103 from Tayca Corporation, with a surface treatment of decylsilane), and 0.3 percent by weight of the film forming additive zinc stearate (obtained from Synpro Inc.) at 2360 RPM for 4 minutes on a Henschel FM-10 blender.

Subsequently, the above formulated toner, 4 parts by weight, was mixed with 96 parts by weight of a carrier comprised of 99 percent by weight of a 65 micron irregularly shaped steel core coated with 1 percent by weight of a Conductex SC Ultra conductive carbon black/poly (methylmethacrylate) composite, and wherein mixing was accomplished in a paint shaker for 10 minutes.

The above prepared toner had a triboelectric charge of 28 microcoulombs per gram, and an admix time of 15 seconds.

The above prepared developer was aged using a bench roll mill technique to simulate xerographic developer housing aging. After 360 minutes of aging, which is equivalent to 60 minutes of aging in, for example, a Xerox Corporation 5090 xerographic developer housing without any toner throughput, the toner cohesion reached a value of 40 to 50 percent, significantly below the cohesion value of 75 to 85 percent reached under the same conditions for a toner with the identical formulation but without the PMMA spacer.

Other modifications of the present invention may occur to those skilled in the art subsequent to a review of the present application, and these modifications, including equivalents thereof, are intended to be included within the scope of the present invention.

What is claimed is:

1. A process for decreasing toner adhesion and decreasing toner cohesion consisting essentially of adding a spacer component of a polymer, a metal, a metal oxide, a metal carbide, or a metal nitride, to the surface of a toner comprised of resin, wax, compatibilizer, and colorant excluding black, and wherein toner surface additives are blended with said toner, and wherein said component is permanently attached to the toner surface by the injection of said component in a fluid bed milling device during the size reduction process of said toner contained in said device, and where the power imparted to the toner to obtain said attachment is from equal to, or about above 5 watts per gram of toner.

2. A process in accordance with claim 1 wherein said component is aluminum oxide, or polymethylmethacrylate, and is added in an amount of from about 1 to about 12 weight percent, the injection is continuous, and the colorant is a pigment.

3. A process in accordance with claim 1 wherein said power is from about 6 to about 15 watts per gram of toner, said component is polymethylmethacrylate, said colorant is a pigment, and the injection is continuous.

4. A process in accordance with claim 1 wherein said component is boron nitride, silicon carbide, silicon nitride, strontium titanate, tin oxide, barium titanate, magnesium titanate, barium zirconate, strontium zirconate, yttrium oxide, aluminum oxide, or aluminum nitride, and said toner surface additives are comprised of silica and titania.

5. A process for decreasing toner adhesion and decreasing toner cohesion which comprises adding a polymer to the surface of a toner comprised of resin, compatibilizer, wax, and colorant excluding black, and wherein the polymer is permanently attached to the toner surface by continuous injection of said polymer in a fluid bed milling device during the size reduction process of the toner, and where the specific power imparted to the toner during said attachment process is equal to, or above about 5 watts per gram of toner.

6. A process in accordance with claim 5 wherein said power is from about 10 to about 15 watts per gram of toner, the colorant is a pigment, the polymer is polymethylmethacrylate, and the injection is continuous.

7. A process in accordance with claim 5 wherein said polymer component is selected in an amount of from about 3 to about 9 weight percent, and the colorant is a pigment.

8. A process in accordance with claim 5 wherein said polymer component is polymethylmethacrylate selected in an amount of form about 6 to about 9 weight percent, and said colorant is a pigment.

9. A process in accordance with claim 5 wherein the toner further includes surface additives.

10. A process in accordance with claim 9 wherein said surface additives are silica, titania, zinc stearate, or mixtures thereof, and wherein each of said additives are selected in an amount of from about 0.1 to about 1 weight percent.

11. A process in accordance with claim 5 wherein said toner is substantially free of aging for about 500,000 imaging cycles in a xerographic imaging or printing apparatus.

12. A process in accordance with claim 6 wherein said toner is substantially free of aging for about 500,000 imaging cycles in a xerographic imaging or printing apparatus.

13. A process in accordance with claim 6 wherein said toner contains surface additives of silica and titanium oxide in an amount of from about 0.1 to about 0.75 weight percent, and which surface additives possess a diameter from about 8 to about 20 nanometers.

14. A process in accordance with claim 5 wherein said resin is a polyester.

15. A process in accordance with claim 5 wherein said colorant is the pigment red, blue, yellow, green, brown, orange, cyan, magenta, or mixtures thereof.

16. A process in accordance with claim 15 wherein said pigment is present in an amount of from about 2 to about 12 weight percent.

17. A process which comprises adding a spacer component with a diameter of from about 100 nanometers to about 500 nanometers to a toner comprised of resin, colorant, wax, compatibilizer, and surface additives, and wherein the component is permanently attached to the toner surface by the continuous injection of said component in a fluid bed milling device during the size reduction process of the toner contained in said device, and where the power imparted to the toner during said attachment is at least about 5 watts per gram of toner.

18. A process in accordance with claim 17 wherein said surface additives are comprised of fumed silica and metal oxides each present in an amount of from about 0.1 to about 0.5 weight percent, and each with a diameter of from about 8 nanometers to about 20 nanometers, said colorant is a pigment excluding black, and said power is from about 10 to about 15 watts.

19. A process in accordance with claim 17 wherein said resin is a styrene acrylate, a styrene methacrylate, a styrene butadiene, or a polyester; the wax is of a low molecular weight $M_w$ of from about 1,000 to about 20,000; and the wax is present in an amount of from about 3 to about 10 weight percent.

20. A process in accordance with claim 17 wherein said toner further contains a charge enhancing additive.

21. A process in accordance with claim 17 wherein said resin is present in an amount of from about 75 to about 95 weight percent, said colorant is a pigment excluding black and is present in an amount of from about 2 to about 12 weight percent, said wax is present in an amount of from about 2 to about 5 weight percent, and said compatibilizer is present in an amount of from about 1 to about 5 weight percent; and wherein said total percent is about 100.

22. A process in accordance with claim 17 wherein said toner is mixed with carrier particles.

23. A process in accordance with claim 22 wherein said carrier contains a coating thereover of a polyvinylidine fluoride, a polymethyl methacrylate, or a mixture of polymers not in close proximity in the triboelectric series.

24. A process which comprises adding a spacer component of polymer to the surface of a toner comprised of resin, wax, compatibilizer, and colorant excluding black, and wherein toner surface additives are optionally blended with said toner, and wherein said spacer component is permanently attached to the toner surface.

25. A process in accordance with claim 24 wherein said polymer is polymethylmethacrylate, and said colorant is a pigment.

26. A process in accordance with claim 1, wherein said spacer component is the polymer polymethylmethacrylate.

27. A process in accordance with claim 1, wherein said spacer component is of a size of from about 100 nanometers to about 500 nanometers.

28. A process in accordance with claim 1, wherein said component is of size of from about 100 to about 200 nanometers and said component is polymethylmethacrylate.

29. A process in accordance with claim 1, wherein the toner cohesion value is from about 10 percent to about 65 percent.

30. A process comprising mixing a toner and a spacer component and wherein said spacer component is of a size from about 100 nanometers to about 500 nanometers and said toner is comprised of toner resin and colorant.

31. A process in accordance with claim 30, wherein the spacer component is a polymer.

32. A process in accordance with claim 30, wherein the spacer component is permanently attached to the toner surface by the injection of said component in a fluid bed milling device and wherein the size of said component is from about 100 to about 500 nanometers and wherein the toner further includes surface additives.

* * * * *